United States Patent [19]

Bell

[11] Patent Number: 4,807,378

[45] Date of Patent: Feb. 28, 1989

[54] ILLUMINATED LOCATION SIGN

[76] Inventor: Harry T. Bell, P.O. Box 1054, 1101 Storey Ave., Murray, Ky. 42071

[21] Appl. No.: 52,270

[22] Filed: May 21, 1987

[51] Int. Cl.[4] ..... G09F 13/04

[52] U.S. Cl. ..... 40/576; 362/812

[58] Field of Search ..... 40/576, 575, 564; 362/812, 240, 249

[56] References Cited

U.S. PATENT DOCUMENTS

| | | | |
|---|---|---|---|
| 1,271,044 | 7/1915 | Leech | 40/576 |
| 2,601,733 | 7/1952 | Durey | 40/576 |
| 2,648,152 | 8/1953 | Simpson | 40/576 |
| 2,764,751 | 9/1956 | Gradke | 40/576 X |
| 2,766,540 | 10/1956 | Brown et al. | 40/576 X |
| 2,893,148 | 7/1959 | Figman | 40/576 |
| 3,553,870 | 1/1971 | Rudolph | 40/576 |
| 4,532,579 | 7/1985 | Merryman | 40/576 X |

*Primary Examiner*—Carlton R. Croyle
*Assistant Examiner*—Ted Olds
*Attorney, Agent, or Firm*—Warren D. Flackbert

[57] ABSTRACT

An illuminated location sign characterized by an open faced housing typically made from a molded plastic resin receiving a light bar on the rear inner surface thereof and including a series of light emitting bulbs disposed on the latter. The face of the housing is arranged to selectively receive and retain a releasable front plate, indicia bearing segments, and a cover member, where the latter serves indicia weathering and/or protective purposes. The light bar is defined by two main power lines onto which the pigtails of the respective light emitting bulbs are secured.

2 Claims, 1 Drawing Sheet

ILLUMINATED LOCATION SIGN

As is known, the need for readily identifying a residence, for example, even at nighttime, is highly desirable. In this connection, and in the usual instance, a house number is generally painted onto or, if solid in form, secured to the region surrounding the entry door; however, the preceding does not satisfactorily reveal the house number under darkened outdoor conditions.

The invention presents an illuminated location sign which overcomes the preceding problem, serving to positively identify a house number by reason of light passing through a series of segments onto which the desired number or indicia are displayed. In other words, and through the selective energization of a series of light emitting bulbs, the numerical house number display is readily identifiable and particularly useful during nighttime hours.

Basically, the invention involves a housing including a face which carries a front plate overlaid by indicia bearing segments, the latter, in turn, being overlaid by transparent cover material which serves sealing and/or weathering purposes. A light bar, secured to the inner surface of the rear wall of the housing, mounts the light emmitting sources, where assembly to an outside power outlet is conventionally accomplished. The indicia bearing segments are readily interchangeable to particularize any given location.

In any event, a better understanding of the present invention will become more apparent from the following description, taken in conjunction with the accompanying drawing, wherein

Figure 1:
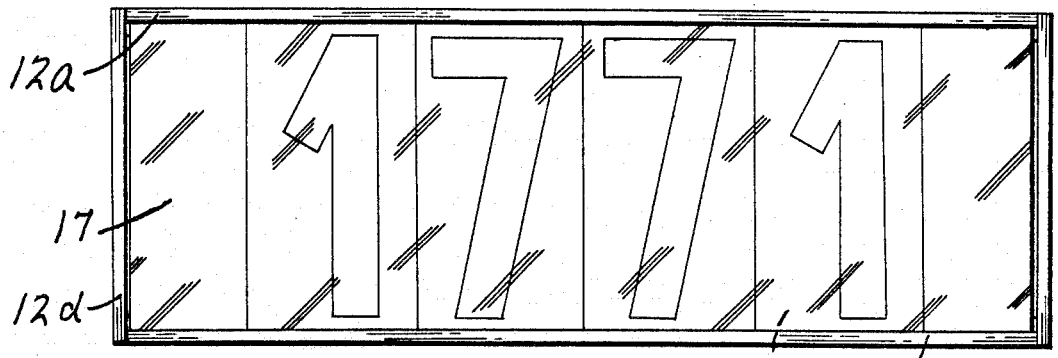
FIG. 1 is a view in front elevation, showing an illuminated location sign in accordance with the teachings of the present invention.
Figure 2:
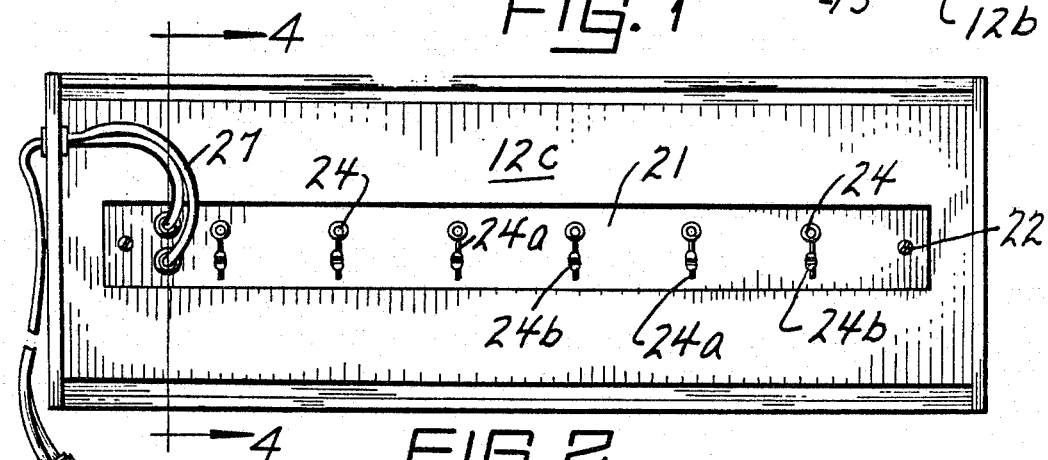
FIG. 2 is another view in front elevation, in this instance with the front of the sign removed, detailing the interior arrangement thereof.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
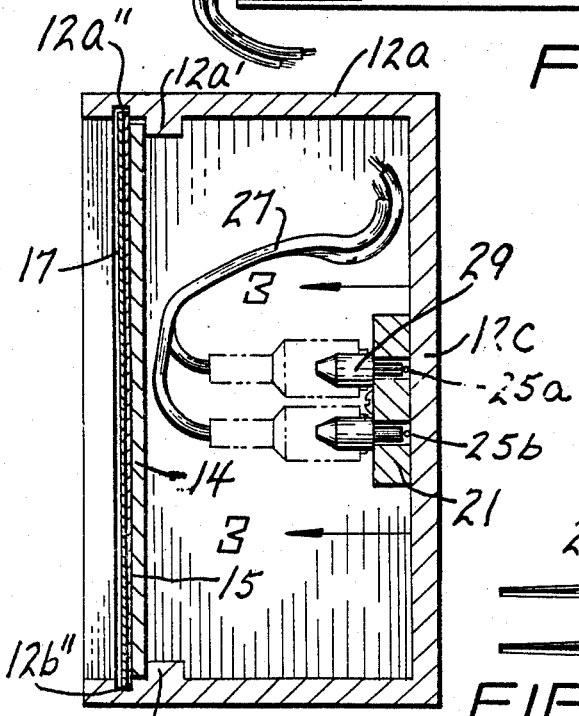
FIG. 4 is a view in vertical section, taken at line 4—4 on FIG. 2 and looking in the direction of the arrows, still further detailing the invention; and, FIG. 5 is a view in end elevation, looking from left to right in FIG. 2.
Figure 5:
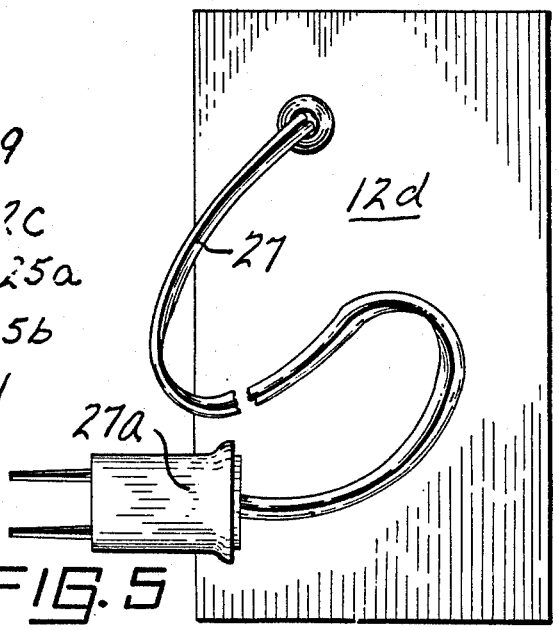

Referring now to the figures, the illuminated location sign presented by the invention is characterized by a housing 12 defined by a top wall **12*a*, a bottom wall 12*b*, a rear wall 12*c* and end walls 12*d*. As particularly evident in FIG. 4, the housing 12, generally unitary and molded from a plastic resin, includes projections 12*a*'–12*b*' and recesses 12*a*''–12'' which serve to position a semi-rigid transparent front plate 14, indicia bearing segments 15 and a transparent cover member 17. Front plate 14 bears against projections 12*a*'–12*b*', while indicia bearing segments 15 and cover member 17 are received in recesses 12*a*''–12*b*'', while indicia bearing segments 15 and cover member 17 are received in recesses 12*a*''–12*b*''**.

In other words, the front plate 14, the indicia bearing segments 15 and the cover member 17 are positively assembled and retained in a use condition, but, as well, are removable for easy access to the cavity presented by the housing 12 and/or for the selective replacement of indicia bearing segments 15.

A light bar 21 is secured, as by threaded means 22, to the inner surface of the rear wall **12*c* of the housing 12. The light bar 21 extends longitudinally along the rear surface and mounts a series of spaced-apart light bulbs 24, such as neon bulbs, which serve to outline the particular indicia presented on the segments 15** during a nighttime use condition.

Figure 3:
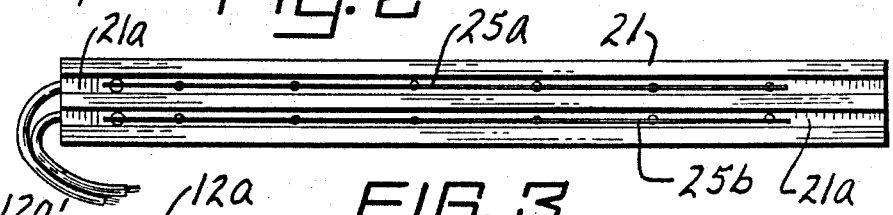
FIG. 3 is a bottom plan view, taken at line 3—3 on FIG. 4 and looking in the direction of the arrows, detailing the light bar employed herewith.

The rear surface of the light bar 21 includes grooves **21*a* into which main power lines 25*a*–25*b* are introduced (see FIG. 3). The main power lines 25*a*–25*b* connect, at 29, to input lines 27 which, through a standard plug 27*a***, connect to a conventional outlet (not shown).

The bulbs 24 each include pigtails **24*a* (and associated dropping resistors 24*b*) which are soldered to the main power lines 25*a*–25*b*, meaning that, upon energization, the bulbs 24 will become illuminated. Typically, and since the light bar 21 is an extruded plastic resin, the preceding soldered assembly is sealed or encased by the use of plastic resin (in grooves 21*a***).

It should be evident, therefore, that the invention provides a simple yet effective approach for location identification, even in the instance of nighttime or darkened conditions. Moreover, and as stated, each of the indicia carrying segments 15 is removable for replacement and/or substitution as needed, i.e. to assure precise residence identification. The cover member 17 serves to protect the indicia carrying segments 15 against the weather or the like. While not detailed herein, provision can also be made, as one or more openings in the rear wall **12*c* of the housing 12**, for hanging the instant illuminated location sign at any desired site.

The arrangement described above is, of course, susceptible to various changes within the spirit of the invention including, by way of example, in proportioning; the light bar arrangement, including the number of bulbs employed; the size and particular color of the indicia on each segment; the provision of an on-off switch for sign illumination control; and, the like. Thus, the preceding should be considered illustrative and not as limiting the scope of the following claims:

I claim:

1. An illuminated location sign comprising a housing including a top wall, a bottom wall, a back wall and end walls, a light bar disposed along the inner surface of said back wall, cooperating projections and recesses on the inner surfaces of said top wall and said bottom wall, and a front member, an indicia carrying segment and a cover member assembled in a sandwiched relationship with respect to each other by said projections and said recesses, where said light bar includes spaced-apart and generally parallel main power lines disposed in grooves extending longitudinally along a base plate, connector means introducing power from incoming power lines into said main power lines, and a plurality of light emitting bulbs each having pigtails connecting said main power lines.

2. The illuminated location sign of claim 1 where said indicia carrying segment is selectively removable.

* * * * *